United States Patent [19]

Bishop

[11] 3,999,765

[45] Dec. 28, 1976

[54] GOLF SWING TRAINING APPARATUS

[75] Inventor: Forest M. Bishop, Richland, Wash.

[73] Assignee: Roy I. Bishop, Olympia, Wash. ; a part interest

[22] Filed: July 18, 1975

[21] Appl. No.: 597,024

[52] U.S. Cl. ..... 273/183 A; 273/193 R; 273/194 B; 273/171; 273/187 A

[51] Int. Cl.[2] ..... A63B 69/36

[58] Field of Search ..... 273/202, 187 A, 193 A, 273/171, 195 A, 193 R, 193 B, 187 R, 26 R, 171, 183 A, 194 B

[56] References Cited

UNITED STATES PATENTS

| | | | |
|---|---|---|---|
| 1,524,196 | 1/1925 | Matthews | 273/193 A X |
| 2,707,638 | 5/1955 | Manley | 273/187 A |
| 2,932,515 | 4/1960 | May | 273/171 X |
| 3,039,770 | 6/1962 | Ferretti | 273/202 X |
| 3,430,964 | 3/1969 | Budzinski | 273/202 X |
| 3,489,416 | 1/1970 | Mark | 273/193 R X |
| 3,765,683 | 10/1973 | Landry | 273/202 |
| 3,868,109 | 2/1975 | Fowler | 273/187 A |
| 3,869,128 | 3/1975 | Ohashi | 273/195 A |

*Primary Examiner*—George J. Marlo
*Attorney, Agent, or Firm*—Eugene D. Farley

[57] ABSTRACT

A golf swing training apparatus for developing a grooved golf swing comprising a short-shafted, weighted golf club and an elevated tee mounted on a base member including club swing path and alignment indicators. The golf club has a short shaft and an adjustably weighted head. The elevated tee is vertically adjustable to accommodate users of various heights.

5 Claims, 3 Drawing Figures

GOLF SWING TRAINING APPARATUS

BACKGROUND OF THE INVENTION

This invention relates in general to a golf swing training apparatus and particularly to such an apparatus having a short-shafted, weighted golf club and an elevated tee.

In any activity where proper timing and form are more instrumental than strength in achieving the desired results, practice becomes of paramount importance. This is particularly true in the game of golf where a properly grooved swing is necessary if the player is to achieve the required degree of consistency.

Accordingly, golf practice devices have become quite common. It is desirable that these practice devices be capable of use with practice balls indoors where restrictive room sizes and low ceilings prevent a normal swing with a full sized golf club.

Thus, prior art devices utilizing a raised tee in conjunction with a short golf club are known in the prior art.

It is also well known to utilize a weighted golf club to force a correct swing, thus developing the required muscles and grooving the swing.

The prior art devices, however, do not disclose an apparatus having the combination of elements necessary to simulate a correct golf swing with a short golf club, and thus force development of a correctly grooved swing.

Accordingly, it is the general object of the present invention to provide a golf swing training apparatus comprising a short-shafted, weighted golf club and an elevated tee used in combination to develop a smooth swing with proper hand and wrist action.

It is a further object of the present invention to provide such an apparatus having a vertically adjustable tee for use by golfers of various heights.

It is a further object of the present invention to provide such an apparatus having means to locate the user's feet, thus properly aligning him with the apparatus.

It is a further object of the present invention to provide such an apparatus having indexing means to index the golf club before and during the golf swing, the indexing means being visible to the user without moving his head.

It is a further object of the present invention to provide such an apparatus having a golf club with an adjustably weighted head.

THE DRAWINGS

The manner in which the foregoing and other objects of the present invention are accomplished will be apparent from the accompanying specification and claims considered together with the drawings wherein:

GENERAL STATEMENT OF THE INVENTION

The present invention generally provides a golf swing training apparatus for developing a grooved golf swing. The apparatus comprises a short-shafted, weighted golf club and elevated tee means.

The short-shafted, weighted golf club includes a short shaft and a head configured releasably to accept weights of various sizes.

The elevated tee means comprises positioning means for positioning the tee at various heights and indexing means to index the golf club and align it during the swing. The apparatus is configured in such a manner that the user can maintain visual contact with the indexing means without moving his head.

DETAILED DESCRIPTION OF A PREFERRED EMBODIMENT

Figure 1:
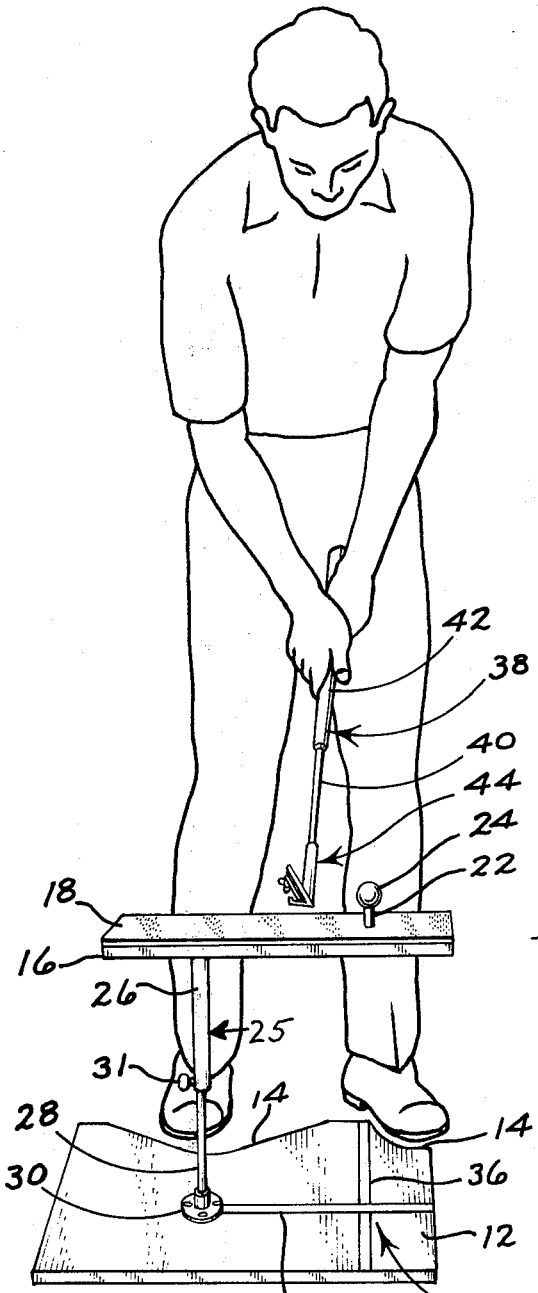
FIG. 1 is a perspective view showing the use of the apparatus of the present invention.

Referring to FIG. 1, the apparatus of the present invention is illustrated as it is typically used.

Elevated tee means 10 comprises base 12 which normally is constructed from a thin, light weight material. It preferably is about 1½ feet in width and 2 to 3 feet in length.

Arcuate foot-locating cutouts 14 are formed in one of the longer edges of the base to align the user's feet in a proper stance when using the apparatus. The forward foot-locating cutout preferably is located at the forward edge of the base, thus removing one corner. The rearward foot-locating cutout is slightly larger and is located a short distance rearwardly of the middle of the base.

Tee plate 16 comprises a thin, preferably rectangular planar element substantially the same length as base 12, but considerably narrower. The tee plate may be covered with material strip 18, made from green felt or one of the artificial turf materials.

Golf tee 22 configured to support golf ball 24 is joined medially to the upper surface of one end portion of tee plate 16. The golf tee preferably is flexible so that it will not break when it is struck with a golf club.

Positioning means 25 positions the tee plate above the base generally over its longitudinal center portion. The positioning means preferably allows for vertical adjustment of the tee plate so that users of various heights may locate the tee plate at the same relative height.

To this end, vertical tube 26 depends from joinder to the under side of the end portion of tee plate 16, opposite that end on which the golf tee is mounted. Shaft 28 having a diameter to telescope into the vertical tube extends upwardly from joinder with base 12. Mounting bracket 30 mounts the shaft on the base. It preferably is located opposite the rearward foot-locating cutout.

After the tee plate has been positioned at the proper height with shaft 28 received in vertical tube 26, clamping means such as thumb screw 31 fixes them in proper working relationship with one another. The lower portion of the vertical tube contains a threaded hole into which the thumb screw is threaded, allowing it frictionally to engage the shaft.

Indexing means 32 is located on the upper surface of base 12 in order to aid the user in indexing the golf club and aligning it during the swing to strike the golf ball properly.

The indexing means comprises a swing strip 34, located along the longitudinal center of the base, and a club alignment stripe 36, located transversely along the forward edge of the base. The stripes are located in such a manner that they intersect at a point directly below the golf tee. Thus each defines a line the projection of which intersects the golf tee. Both stripes preferably are narrow and of a color contrasting to that of the base in order that they may be visible readily by the user.

Figure 3:
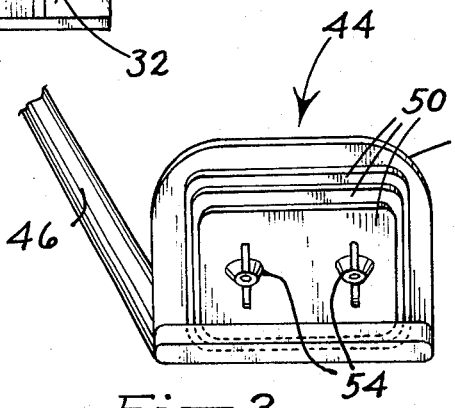
FIG. 3 is a front elevation view of the golf club looking in the direction of the arrows of line 3—3 of FIG. 2.
Figure 2:
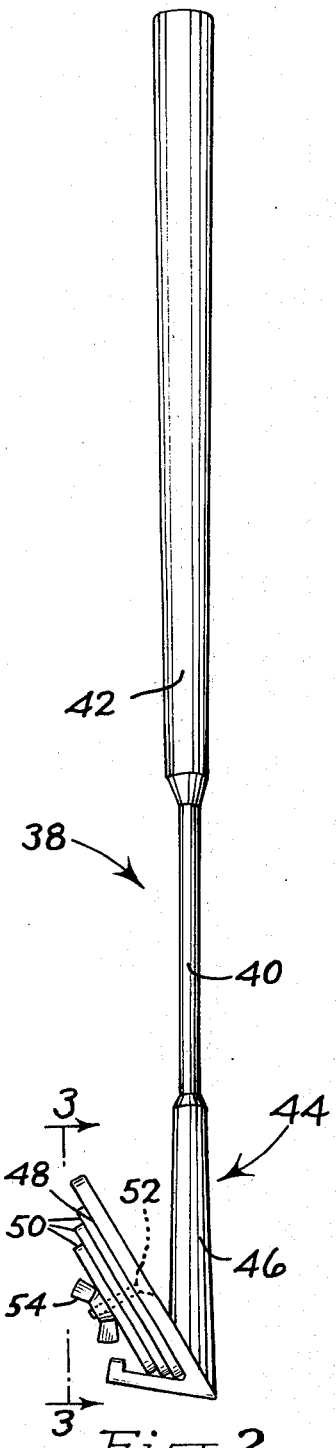
FIG. 2 is a side elevation view of the short-shafted, weighted golf club of the apparatus.

Short-shafted, weighted golf club 38 is used with elevated tee means 10 in the apparatus of the present invention. As shown in FIGS. 2 and 3, it comprises a short golf club shaft 40 with grip means 42 joined to one end. The short golf club shaft and the grip means are similar to that utilized in normal golf clubs of the iron class; however, the short golf club shaft is of a length to make the resulting golf club approximately 18 inches long, allowing its use with the elevated tee means. The user thus can take his normal stance when addressing the ball, as shown in FIG. 1.

Adjustably weighted head means 44 is joined to the lower end of short golf club shaft 40 by cylindrical joinder element 46.

The adjustably weighted head means comprises wedge shaped base 48 having a planar bottom portion and a striking portion joined at their forward edges to form an acute angle. The resulting head means is similar in shape and angle to a normal 5 iron, but with a larger, symmetrical striking portion.

Weight plates 50 configured to nest in the wedge shaped base behind its striking portion and above its bottom portion. They are similar in shape to the bottom portion of the base, but each successive weight plate is smaller, to provide a series of graduated weights the use of which makes possible the assembly of a club head of the desired total weight.

Joinder means, in this instance machine screws 52 and wing nuts 54, releasably join the weight plates to the striking portion of the wedge shaped base. Counter sunk holes are utilized to maintain a flush face on the striking portion.

The manner of use of the herein described apparatus is as follows:

In the first instance, positioning means 25 is positioned to locate tee plate 16 at the proper height, and thumb screw 31 is tightened to maintain the position. The height of the tee plate should be such that the user can address the ball with a stance similar to that used with a ground teed ball and a club of normal length.

The user's feet are positioned in arcuate foot-locating cutouts 14, as shown in FIG. 1. The user is thus positioned properly relative to the tee and can make a proper swing. The short golf club is lined up visually with club alignment stripe 36. The user then is ready to take his normal golf swing. As he swings, he makes the lower portion of the swing follow along the swing stripe in order to strike the ball correctly.

It will be noted that the narrow width of the tee plate and the short length of the club allow the user to maintain visual contact with the indexing means without head movement throughout the golf swing.

If all of the weight plates are installed, the user is forced to make a smooth, continuous swing, properly rolling his hands after striking the ball. Thus, the golf swing becomes grooved and proper muscle development and coordination are achieved upon repetitive use of the apparatus. However, if desired, some of the weights may be removed to simulate the feel of a normal club. In this case the short shaft still allows for practice utilizing practice balls within a confined area, or if desired, regular golf balls outside.

Having thus described my invention in a preferred embodiment, I claim:

1. A golf swing training apparatus for developing a grooved golf swing, comprising in combination:

a. a golf club comprising
   1. a short golf club shaft,
   2. a hand grip on one end of the shaft, and
   3. a golf ball striking head on the other end of the shaft, b. and an elevated golf tee comprising
   1. a base,
   2. a tee plate having a longitudinal dimension,
   3. positioning means for supporting the tee plate spaced vertically above the base with its longitudinal dimension extending in a forward direction,
   4. means adjacent the forward end of the tee plate forming a golf tee for supporting a golf ball, and
   5. indexing means on the base forming a visible swing line extending in the forward direction of the tee plate and intersecting the vertical axis of the golf tee, and a visible golf club alignment line extending perpendicular to the swing line and intersecting said vertical axis of the golf tee.

2. The apparatus of claim 1 wherein the positioning means comprises:

a. a vertical tube and a communicating shaft telescoping into the vertical tube, one secured to and depending from the bottom of the tee plate and the other secured to and extending upward from the base, and b. clamping means arranged to clamp the vertical tube and shaft in predetermined positions of telescopic extension.

3. The apparatus of claim 1 wherein the golf club head comprises:

a. a wedge-shaped base having a bottom portion and a striking portion forming an acute angle therebetween, b. a plurality of weight plates arranged to fit behind the striking portion above the bottom portion, and c. means on the back side of the striking portion for releasably securing the weight plates thereto.

4. A golf swing training apparatus for developing a grooved golf swing, comprising:

a. a short-shafted golf club, and b. an elevated golf tee comprising
   1. a base,
   2. a tee plate having a longitudinal dimension,
   3. positioning means for supporting the tee plate spaced vertically above the base with its longitudinal dimension extending in a forward direction,
   4. means adjacent the forward end of the tee plate forming a golf tee for supporting a golf ball, and
   5. indexing means on the base forming a visible swing line extending in the forward direction of the tee plate and intersecting the vertical axis of the golf tee, and a visible golf club alignment line extending perpendicular to the swing line and intersecting said vertical axis of the golf tee.

5. The apparatus of claim 4 wherein the positioning means comprises:

a. a vertical tube and a communicating shaft telescoping into the vertical tube, one secured to and depending from the bottom of the tee plate and the other secured to and extending upward from the base, and b. clamping means arranged to clamp the vertical tube and shaft in predetermined positions of telescopic extension.

* * * * *